United States Patent [19]

Reinebach

[11] 4,172,964

[45] Oct. 30, 1979

[54] PACKAGED INDUCTIVE COIL ASSEMBLY

[75] Inventor: Robert J. Reinebach, Westchester, Ill.

[73] Assignee: Western Electric Company, Incorporated, New York, N.Y.

[21] Appl. No.: 864,303

[22] Filed: Dec. 27, 1977

[51] Int. Cl.[2] ..... H01F 27/02; H01F 15/02; H01F 17/08

[52] U.S. Cl. ..... 178/46; 336/67; 336/68; 336/92; 336/96

[58] Field of Search ..... 178/45, 46; 336/65, 336/67, 68, 90, 92, 96, 107; 174/52 R, 52 PE, 52 S

[56] References Cited

U.S. PATENT DOCUMENTS

| | | | |
|---|---|---|---|
| 934,811 | 9/1909 | Howe | 178/46 |
| 1,449,666 | 3/1923 | Gilchrist et al. | 336/65 X |
| 2,079,697 | 5/1937 | Ranges | 336/180 X |
| 2,147,245 | 2/1939 | Cox | 178/46 |
| 2,548,205 | 4/1951 | Drobish | 178/46 |
| 2,692,302 | 10/1954 | Graves | 178/46 |
| 3,526,712 | 9/1970 | Drom | 178/46 |
| 3,691,294 | 9/1972 | Charles | 336/65 X |
| 3,943,412 | 3/1976 | Wickstrom | 336/67 X |
| 3,964,009 | 6/1976 | Bernstein et al. | 336/92 X |

FOREIGN PATENT DOCUMENTS 366791 2/1932 United Kingdom.

*Primary Examiner*—Alfred E. Smith
*Assistant Examiner*—Marvin Nussbaum
*Attorney, Agent, or Firm*—R. P. Miller

[57] ABSTRACT

Two stacks of individual loading coils are mounted on the arms of a U-shaped bracket which is supported on a divider wall of a contoured plastic case having a pair of compartments for receiving the coil stacks. The cross-arm of the bracket is shaped to fit within a correspondingly shaped notch formed in the divider wall to centrally position the stacks of coils within the compartments. In another embodiment spacer ribs project from the inner walls of the housing to provide means for accurately locating the stacks within the compartments. Encapsulating medium is introduced into the case to protect the coils and provide electrical isolation between the coil stacks.

10 Claims, 7 Drawing Figures

FIG. 3
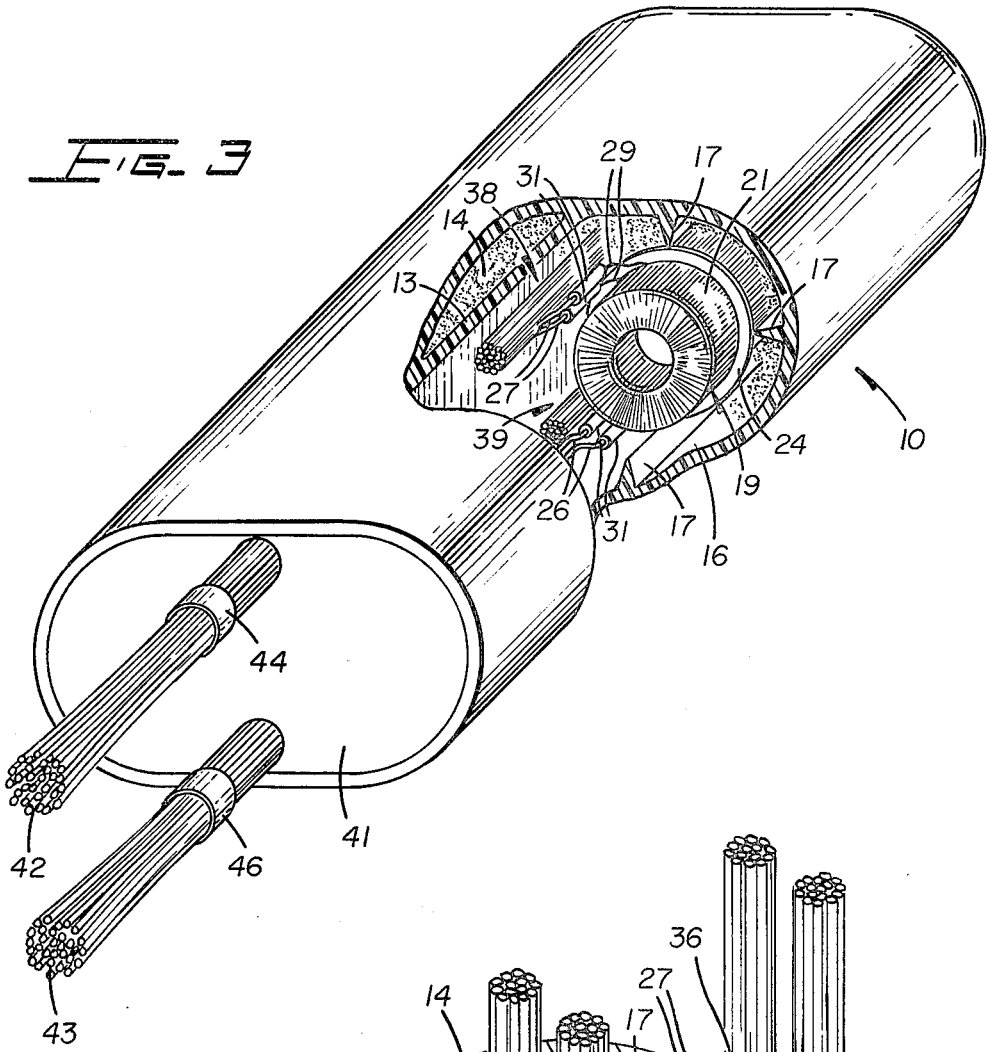
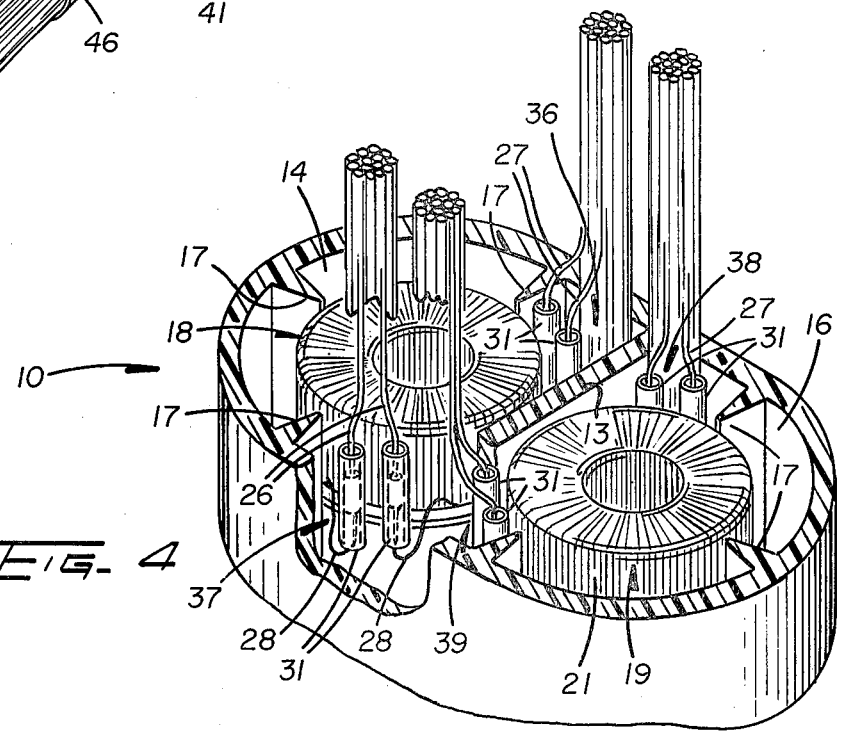
FIG. 4

PACKAGED INDUCTIVE COIL ASSEMBLY

TECHNICAL FIELD OF THE INVENTION

This invention relates to a compact packaged induction coil assembly, and more particularly to a unique loading coil case configuration and mounting for individual stacks of loading coils to provide spaces for connecting coil wires for cable wires.

BACKGROUND ART

Stacks of loading coils find extensive use in the telephone industry where the individual coils are connected to wire pairs to balance the capacitance effect of these wires which are used as transmission lines from a central telephone office to a subscriber's telephone.

A number of expedients have been devised and used to package several loading coils in a container; for example, see U.S. Pat. No. 2,147,245 for a disclosure of a metal tube-like container; U.S. Pat. No. 2,548,205 for a disclosure of a cardboard tube container for receiving a single stack of coils, and U.S. Pat. No. 2,692,302 for a disclosure of a metal screen container tube. British Pat. No. 366,791 shows a cast iron case into which a plurality of cylindrical containers of loading coils are suspended.

There still is a need for a compact lightweight loading coil assemblage which can be used alone or with a number of similar assemblages to provide the necessary inductance to balance capacitance between transmission lines installed in the field.

These coil assemblages, which may be termed coil cases or coil packs, should permit easy assembly in the factory. Further, the coil case should permit assembly in the field of a number of other similar cases within an outer casing which receives encapsulant to provide electrical isolation between the coil packs, and further insure protection from rough handling and environmental attack. These coil packs should be compactly assembled with isolators and encapsulant to assure electrical isolation between each coil in each stack, and isolation between a pair of stacks mounted within a single case.

SUMMARY OF THE INVENTION

The present invention contemplates, among other things, a compact lightweight loading coil assemblage which lends itself to association with other like coil assemblages within an outer plastic housing or casing which subsequently receives an encapsulant.

More particularly, the present invention includes an oval-shaped case with a divider to provide a pair of compartments into which are suspended two stacks of loading coils. The suspension and construction of the case provides convenient wiring spaces in which coil wires are connected to cable wires. Spacer ribs project from the inner walls of the compartment to position the stacks of the coils. The stacks of coils may be positioned by mounting the stacks on the arms of a U-shaped bracket having a configured crossarm which fits within a similarly configured notch formed in the case divider wall. With these mounting arrangements, the stacks of coils may be completely encapsulated within the case.

BRIEF DESCRIPTION OF THE DRAWINGS

A more complete understanding of the invention may be had by referring to the following detailed description when considered in conjunction with the accompanying drawings, wherein

FIG. 3 is a perspective view of the oval-shaped loading coil case shown in FIGS. 1 and 2, and partially cut away to illustrate the wiring spaces existing at the juncture of the oval walls and a divider bisecting the case into two compartments;

FIG. 4 is a perspective view of a section of the loading coil assembly shown in the other figures to depict the cable wire and coil wire connections in the wiring spaces;

DETAILED DESCRIPTION

Figure 1:
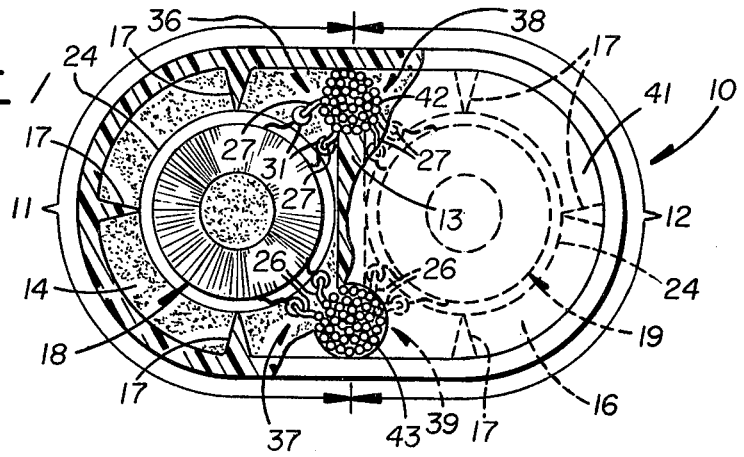
FIG. 1 is a top view of a compact loading coil assembly embodying the principles of the invention, and this view is partially cut away to illustrate the positionment of two stacks of loading coils to provide wiring spaces within a divided plastic case.
Figure 2:
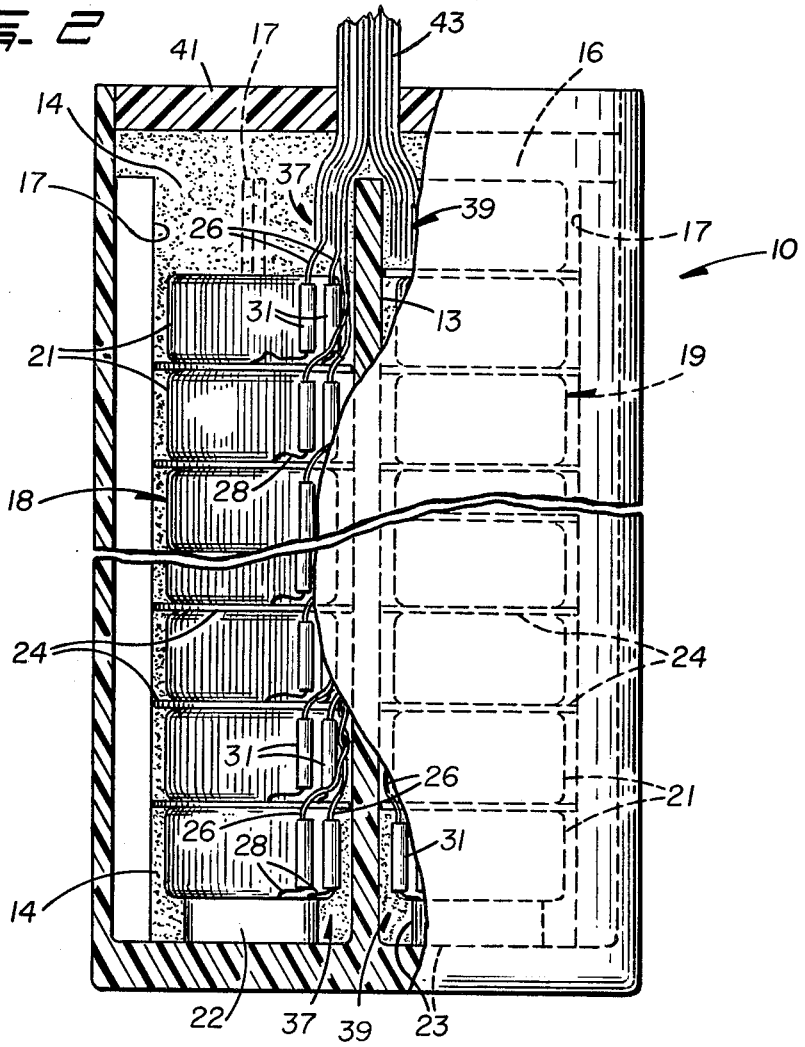
FIG. 2 is a side view of the loading coil assembly shown in FIG. 1, and is partially cut away to show the stacks of loading coils and the interconnection of loading coil wires with cable wires.

Referring to FIGS. 1 and 2 there is shown a loading coil assemblage or module comprising a substantially oval-shaped case 10 formed of a plastic material, such as polyethylene. The case has two arcuate sections 11 and 12, and a centrally located divider wall 13 located along the minor axis of the oval to separate the case into two compartments 14 and 16. The case is formed with a plurality of inwardly extending spacers 17 which serve to position two stacks 18 and 19 of individual loading coils 21 from the inner arcuate walls of the case 10. Each coil 21 of the respective stacks comprises two windings of insulated wire wound around a central toroidal core of a material having good magnetic properties, such as Permalloy.

The stacks 18 and 19 of loading coils 21 are loaded into the case 10 and rest on spacer blocks 22 and 23 formed of an electrical insulating material, e.g., polyurethane. The spacer ribs 17 position the peripheries of the coil stacks adjacent opposite walls of the divider 13. Following placement of each coil, an insolator disc 24 is positioned on top of the coil. This isolator disc is coated with an epoxy resin and is constructed of a material having good magnetic properties so as to preclude inducing flux from one coil into the adjacent coil.

Each of the two windings making up each toroidial coil is connected to a pair of cable wires such as denoted by the reference numerals 26 and 27. As best shown in FIGS. 3 and 4, the cable wires 26 and 27 are twisted about coil wires denoted by the reference numerals 28 and 29, and then further secured by applying a glob of solder. Prior to twisting and soldering the cable and coil wires, insulating plastic sleeves 31 are placed over the ends of the cable wires 26 and 27. After the soldered wire connections are made, the sleeves may be slid down over the connections to electrically insulate the connections from each other.

It is significant to note that the oval case and divider wall construction provide a series of four wiring spaces 36, 37, 38 and 39 at the juncture of the straight divider wall 13 with the arcuate sections 11 and 12 of the case 10. This construction enables the running of the cable wires 26 and 27 to the individual loading coils, and further provides sufficient space to accommodate the connections between the cable wires and the coil wires.

The case 10 is encapsulated with an insulating material, such as polyurethane, which is illustrated in the drawings by the dotted portions of the interior of the case 10. The case or module 10 is further sealed by flowing a layer of epoxy resin into the form a plug seal 41. The cable wires extend through the seal 41 and are gathered in bundles 42 and 43 which are secured by bands 44 and 46.

The completed module 10 may be associated with a number of other modules to provide a loading coil assemblage which is further encased in an outer housing, not shown. This assemblage of modules will occur in the field when the modules are connected by means of the bundles of cable wires to transmission wires connected as communicating paths between a central office and a subscriber's telephone or other terminal equipment.

Figure 6:
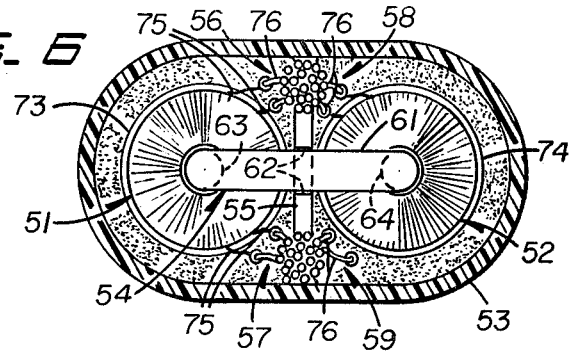
FIG. 6 is a sectional view taken along line 6-6 of FIG. 5 showing the top of the U-shaped bracket locked in a notch formed in the divider wall.
Figure 7:
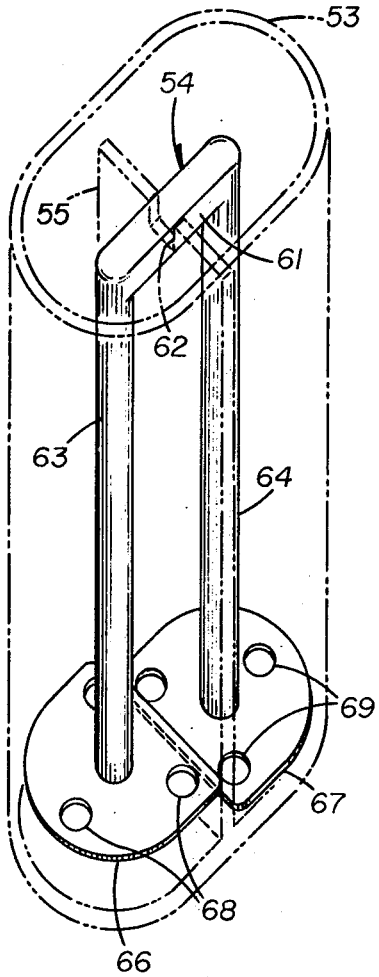
FIG. 7 is a schematic, perspective view of the configuration of the U-shaped bracket and retainer means for holding stacks of loading coils on the arms of the bracket.
Figure 5:
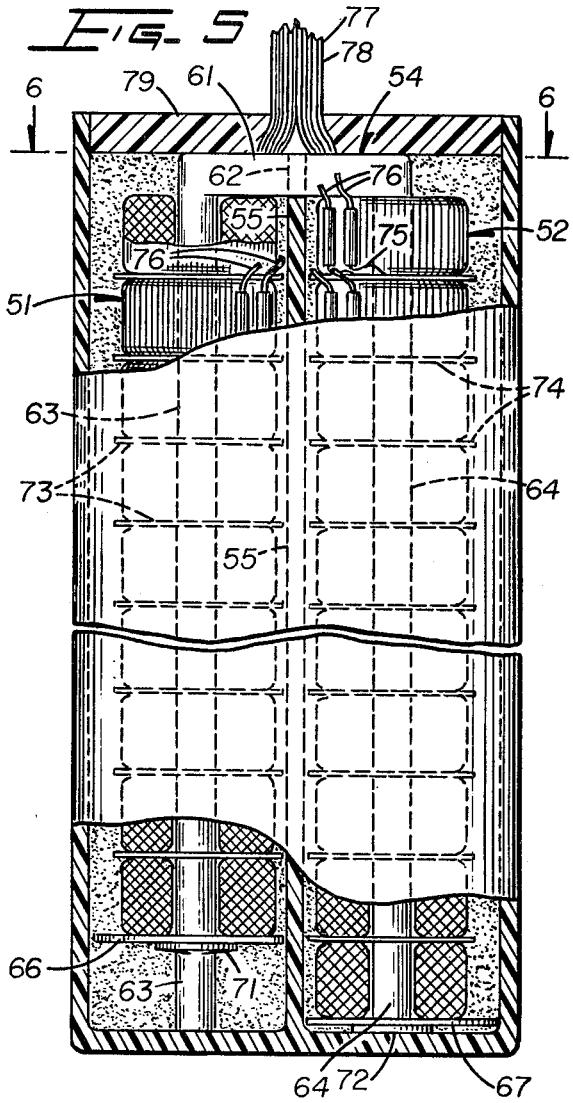
FIG. 5 is a side view of a further embodiment of the invention partially cut away to show a U-shaped bracket for supporting stacks of loading coils within compartments formed in an oval-shaped case.

Referring now to FIGS. 5, 6 and 7, there is shown a further embodiment of the invention wherein stacks 51 and 52 of individual loading coils are positioned within a substantially oval-shaped case or housing 53 by means of a U-shaped bracket 54. In this embodiment, the case 53 is again provided with a divider wall 55 to form the wiring spaces 56, 57, 58 and 59 between the peripheries of the coils and the junctures of the straight divider walls with the inner walls of the arcuate sections of the case 53. The divider wall is located along the minor axis of the oval-shaped case to divide the interior of the case into two coil receiving compartments.

As particularly illustrated in FIG. 7, the U-shaped bracket 54 includes a crossarm 61 of substantial square cross section. The U-shaped bracket is constructed of an insulating material, such as fiberglass. This crossarm 61 is fitted within a rectilinear or substantially square-shaped notch 62 formed to extend downwardly from the top edge of the divider wall 55. Depending from the crossarm 61 are a pair of substantially round support arms 63 and 64 on which the individual loading coils are mounted to form the two spaced stacks 51 and 52 of coils.

Secured to the lower extremities of the depending arms 63 and 64 are a pair of retainer plates 66 and 67 having holes 68 and 69 formed therein. The retainer plates are secured to the U-shaped bracket by fasteners, e.g., speed nuts 71 and 72. Interposed between the coils 51 and 52 are spacer discs 73 and 74, each of which is constructed of a good magnetic material to preclude the flux about each coil being induced in the adjacent coil. The spacer discs 73 and 74 are coated with an epoxy to insure electrical isolation between the windings of the respective coils.

In the assembly of the modules shown in FIGS. 5, 6 and 7, the individual loading coils 51 and 52 and the interposed insulating spacers 73 and 74 are mounted on the arms 63 and 64 of the bracket 54. Retainer plates 66 and 67 are secured to the ends of the arms by assembly of the speed nuts 71 and 72. The end sections of two pairs of individual coil wires 75 of each coil are wrapped or twisted about the end sections of two pairs 76 of cable wires. The cable wires are gathered together to form bundles 77 and 78 which comprise a stub cable which can be connected or spliced to the wires of a transmission cable to balance the effect of capacitance between the pairs of wires making up the transmission cable.

The assembled coils, wires and the bracket are inserted in the case 53 so that the crossarm 61 fits within the notch 62 to position the stacks of coils in a spaced relation with respect to the inner wall of the case. To insure the central positioning of the bracket arms 63 and 64, the retainers 66 and 67 are configured to conform with the substantially semi-circular or oval configuration of the compartments defined by the inner walls of the case 53.

It will be noted that the retainers 66 and 67 are spaced from the bottom of the case so that the introduction of encapsulant results in the encapsulant flowing around the coils and through the holes 68 and 69 to the undersides of the stacks of coils. This encapsulant, which may be polyurethane and is illustrated by the dotted portions of the interior of the case 53, further stabilizes the position of the coils in the case during subsequent handling and wiring in the field. The encapsulated assembly is further sealed by flowing a layer 79 of insulating material on top of the encapsulant. This layer solidifies to form a moistureproof seal with the case 53.

Again it will be noted that the structural arrangement of the bracket, the inner walls of the case 53 and the divider wall 55 provide adequate wiring spaces for the cable wires and the connections to the coil wires. In both illustrated embodiments these wiring spacers are established at each juncture of the straight divider wall with a section of the arcuate wall of the case.

Also, it should be noted that in both disclosed embodiments, the stacks are spaced from the inner arcuate wall sections to permit the free flow of an encapsulant about the coils. In the embodiment shown in FIGS. 1 to 4, the inwardly projecting ribs engage the interposed discs, thus leaving the outer peripheries of the coils free of engagement with the inner walls to permit the free flow of encapsulant about the entire outer periphery of each coil. An inspection of the embodiment shown in FIGS. 5 and 6 clearly shows that the bracket and retainer plate position and support the coil stacks to permit the free flow of encapsulant about the outer peripheries of the individual coils.

What is claimed is:

1. A loading coil assembly, which comprises:

a case having a pair of arcuate-shaped wall sections and a straight divider wall joining the ends of the arcuate-shaped wall sections to form a pair of compartments;

a stack of toroidal loading coils within each of said compartments;

means for positioning the stacks of coils within said compartments with the peripheries of the loading coils being evenly spaced from the arcuate inner surfaces of the arcuate-shaped wall sections to provide a pair of enlarged wiring spaces between the outer periphery of each of said stacks of loading coils and the junctures of the straight divider wall with the arcuate walls; and cable wires extending into said wiring spaces and secured therein to the wires of the coils.

2. A loading coil assembly as defined in claim 1, wherein said coil positioning means comprises a plurality of ribs inwardly projecting from said arcuate wall section.

3. A loading coil assembly as defined in claim 2, which includes:

a plurality of insulated metal discs individually interposed between each coils, said disc having a periphery larger than the periphery of said coils and engaged by said inwardly projecting ribs.

4. A loading coil assembly as defined in claim 2, wherein the coil positioning means includes a bracket having an arm fitted within a notch formed in said divider wall and an arm depending into said compartment about which said coils are coaxially positioned, and retainer means secured to the depending arm to hold the stack of coils.

5. A loading coil assembly, which comprises:

a housing having a divider wall separating the interior of the housing into two compartments;

a coil positioning structure having a crossarm extending across the divider wall and a pair of depending legs extending into central portions of said compartments;

coil retaining means attached to the lower extremities of said depending legs;

stacks of individual toroidal loading coils mounted coaxially on said legs and supported by said retaining means, each of said coils having an outer peripheral surface which is spaced from the interior walls of said compartment; and an encapsulant material encasing the coils within the housing.

6. A loading coil assembly as defined by claim 5, wherein the divider wall is provided a notch on its upper edge to receive said crossarm.

7. A loading coil assembly, as defined in claim 6, wherein the crossarm is substantially square in cross section and said notch is square to fix the location of the depending legs within the compartments.

8. A loading coil assembly, as defined in claim 7, wherein said depending legs are of circular cross section.

9. A loading coil assembly, which comprises:

a substantially oval-shaped case of electrically insulating material having a bottom and an open top, said case having a straight divider wall positioned along a centrally located minor axis of the case to form two coil receiving compartments; said divider wall having a centrally located rectilinear configured notch formed in the upper edge thereof;

a U-shaped bracket having a crossarm having a rectilinear cross section corresponding to the configuration of said rectilinear notch, said bracket crossarm fitted into said notch with depending arms extending into said compartments;

retainer plates mounted on the lower extremities of said depending arms;

two stacks of toroidal loading coils coaxially positioned about said arms and supported on said retainer plates to provide wiring spaces between the peripheries of the coils and the junctures of the straight wall with with arcuate sections of the oval case; and cable wires extending into said wiring spaces and individually secured to the individual coil wires of the loading coils.

10. A loading coil assembly as defined in claim 9, wherein the retainer plates are shaped to conform to the shape of the interior of said compartments.

* * * * *